US007525528B2

(12) United States Patent
Feng

(10) Patent No.: US 7,525,528 B2
(45) Date of Patent: Apr. 28, 2009

(54) TECHNIQUE THAT PRESERVES SPECULAR HIGHLIGHTS

(75) Inventor: Xiao-Fan Feng, Vancouver, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 621 days.

(21) Appl. No.: 11/233,748

(22) Filed: Sep. 22, 2005

(65) Prior Publication Data

US 2006/0103621 A1 May 18, 2006

Related U.S. Application Data

(60) Provisional application No. 60/628,799, filed on Nov. 16, 2004.

(51) Int. Cl.
*G09G 3/36* (2006.01)

(52) U.S. Cl. ..... 345/87; 345/102

(58) Field of Classification Search ..... 345/81, 345/87, 102, 690, 691, 644
See application file for complete search history.

(56) References Cited

U.S. PATENT DOCUMENTS

| | | | |
|---|---|---|---|
| 3,329,474 | A | 7/1967 | Harris et al. |
| 3,375,052 | A | 3/1968 | Kosanke et al. |
| 3,428,743 | A | 2/1969 | Hanlon |
| 3,439,348 | A | 4/1969 | Harris et al. |
| 3,499,700 | A | 3/1970 | Harris et al. |
| 3,503,670 | A | 3/1970 | Kosanke et al. |
| 3,554,632 | A | 1/1971 | Chitayat |
| 3,947,227 | A | 3/1976 | Granger et al. |
| 4,012,116 | A | 3/1977 | Yevick |
| 4,110,794 | A | 8/1978 | Lester et al. |
| 4,170,771 | A | 10/1979 | Bly |
| 4,187,519 | A | 2/1980 | Vitols et al. |
| 4,384,336 | A | 5/1983 | Frankle et al. |
| 4,385,806 | A | 5/1983 | Fergason |

(Continued)

FOREIGN PATENT DOCUMENTS

EP 0 732 669 A1 9/1996

(Continued)

OTHER PUBLICATIONS

Youngshin Kwak and Lindsay W. MacDonald, "Accurate Prediction of Colours on Liquid Crystal Displays," Colour & Imaging Institute, University of Derby, Derby, United Kingdom, IS&T/SID Ninth Color Imaging Conference, pp. 355-359, Date Unknown.

(Continued)

*Primary Examiner*—Amare Mengistu
*Assistant Examiner*—Hong Zhou
(74) *Attorney, Agent, or Firm*—Chernoff, Vilhauer, McClung & Stenzel

(57) ABSTRACT

A method for displaying an image on a liquid crystal display that includes a plurality of light emitting elements and a light valve. A image signal is received and a first light emitting element is illuminated based upon a substantial maximum of a non-uniform image signal in a first region. A second light emitting element is illuminated based upon a substantial maximum of a non-uniform image signal in a second region including, where the first and second light emitting elements are simultaneously illuminated.

8 Claims, 6 Drawing Sheets

Flow chart of deriving LED and LCD driving values for HDR display

U.S. PATENT DOCUMENTS

| | | | |
|---|---|---|---|
| 4,410,238 | A | 10/1983 | Hanson |
| 4,441,791 | A | 4/1984 | Hornbeck |
| 4,516,837 | A | 5/1985 | Soref et al. |
| 4,540,243 | A | 9/1985 | Fergason |
| 4,562,433 | A | 12/1985 | Biferno |
| 4,574,364 | A | 3/1986 | Tabata et al. |
| 4,611,889 | A | 9/1986 | Buzak |
| 4,648,691 | A | 3/1987 | Oguchi et al. |
| 4,649,425 | A | 3/1987 | Pund |
| 4,682,270 | A | 7/1987 | Whitehead et al. |
| RE32,521 | E | 10/1987 | Fergason |
| 4,715,010 | A | 12/1987 | Inoue et al. |
| 4,719,507 | A | 1/1988 | Bos |
| 4,755,038 | A | 7/1988 | Baker |
| 4,758,818 | A | 7/1988 | Vatne |
| 4,766,430 | A | 8/1988 | Gillette et al. |
| 4,834,500 | A | 5/1989 | Hilsum et al. |
| 4,862,270 | A | 8/1989 | Nishio |
| 4,862,496 | A | 8/1989 | Kelly et al. |
| 4,885,783 | A | 12/1989 | Whitehead et al. |
| 4,888,690 | A | 12/1989 | Huber |
| 4,910,413 | A | 3/1990 | Tamune |
| 4,917,452 | A | 4/1990 | Liebowitz |
| 4,918,534 | A | 4/1990 | Lam et al. |
| 4,933,754 | A | 6/1990 | Reed et al. |
| 4,954,789 | A | 9/1990 | Sampsell |
| 4,958,915 | A | 9/1990 | Okada et al. |
| 4,969,717 | A | 11/1990 | Mallinsoh |
| 4,981,838 | A | 1/1991 | Whitehead |
| 4,991,924 | A | 2/1991 | Shankar et al. |
| 5,012,274 | A | 4/1991 | Dolgoff |
| 5,013,140 | A | 5/1991 | Healey et al. |
| 5,074,647 | A | 12/1991 | Fergason et al. |
| 5,075,789 | A | 12/1991 | Jones et al. |
| 5,083,199 | A | 1/1992 | Borner |
| 5,122,791 | A | 6/1992 | Gibbons et al. |
| 5,128,782 | A | 7/1992 | Wood |
| 5,138,449 | A | 8/1992 | Kerpchar |
| 5,144,292 | A | 9/1992 | Shiraishi et al. |
| 5,164,829 | A | 11/1992 | Wada |
| 5,168,183 | A | 12/1992 | Whitehead |
| 5,187,603 | A | 2/1993 | Bos |
| 5,202,897 | A | 4/1993 | Whitehead |
| 5,206,633 | A | 4/1993 | Zalph |
| 5,214,758 | A | 5/1993 | Ohba et al. |
| 5,222,209 | A | 6/1993 | Murata et al. |
| 5,224,178 | A | 6/1993 | Madden et al. |
| 5,247,366 | A | 9/1993 | Ginosar et al. |
| 5,256,676 | A | 10/1993 | Hider et al. |
| 5,293,258 | A | 3/1994 | Dattilo |
| 5,300,942 | A | 4/1994 | Dolgoff |
| 5,305,146 | A | 4/1994 | Nakagaki et al. |
| 5,311,217 | A | 5/1994 | Guerin et al. |
| 5,313,225 | A | 5/1994 | Miyadera |
| 5,313,454 | A | 5/1994 | Bustini et al. |
| 5,317,400 | A | 5/1994 | Gurley et al. |
| 5,337,068 | A | 8/1994 | Stewart et al. |
| 5,339,382 | A | 8/1994 | Whitehead |
| 5,357,369 | A | 10/1994 | Pilling et al. |
| 5,359,345 | A | 10/1994 | Hunter |
| 5,369,266 | A | 11/1994 | Nohda et al. |
| 5,369,432 | A | 11/1994 | Kennedy |
| 5,386,253 | A | 1/1995 | Fielding |
| 5,394,195 | A | 2/1995 | Herman |
| 5,395,755 | A | 3/1995 | Thorpe et al. |
| 5,416,496 | A | 5/1995 | Wood |
| 5,422,680 | A | 6/1995 | Lagoni et al. |
| 5,426,312 | A | 6/1995 | Whitehead |
| 5,436,755 | A | 7/1995 | Gueria |
| 5,450,498 | A | 9/1995 | Whitehead |
| 5,456,255 | A | 10/1995 | Abe et al. |
| 5,461,397 | A | 10/1995 | Zhang et al. |
| 5,471,225 | A | 11/1995 | Parks |
| 5,471,228 | A | 11/1995 | Ilcisin et al. |
| 5,477,274 | A | 12/1995 | Akiyoshi |
| 5,481,637 | A | 1/1996 | Whitehead |
| 5,537,128 | A | 7/1996 | Keene et al. |
| 5,570,210 | A | 10/1996 | Yoshida et al. |
| 5,579,134 | A | 11/1996 | Lengyel |
| 5,580,791 | A | 12/1996 | Thorpe et al. |
| 5,592,193 | A | 1/1997 | Chen |
| 5,617,112 | A | 4/1997 | Yoshida et al. |
| 5,642,015 | A | 6/1997 | Whitehead et al. |
| 5,642,128 | A | 6/1997 | Inoue |
| D381,355 | S | 7/1997 | Frank-Braun |
| 5,650,880 | A | 7/1997 | Shuter et al. |
| 5,652,672 | A | 7/1997 | Huignard et al. |
| 5,661,839 | A | 8/1997 | Whitehead |
| 5,682,075 | A | 10/1997 | Bolleman et al. |
| 5,684,354 | A | 11/1997 | Gleckman |
| 5,689,283 | A | 11/1997 | Shirochi |
| 5,715,347 | A | 2/1998 | Whitehead |
| 5,717,421 | A | 2/1998 | Katakura et al. |
| 5,717,422 | A | 2/1998 | Fergason |
| 5,729,242 | A | 3/1998 | Margerum et al. |
| 5,748,164 | A | 5/1998 | Handschy et al. |
| 5,751,264 | A | 5/1998 | Cavallerano et al. |
| 5,754,159 | A | 5/1998 | Wood et al. |
| 5,767,828 | A | 6/1998 | McKnight |
| 5,767,837 | A | 6/1998 | Hara |
| 5,774,599 | A | 6/1998 | Muka et al. |
| 5,784,181 | A | 7/1998 | Loiseaux et al. |
| 5,796,382 | A | 8/1998 | Beeteson |
| 5,809,169 | A | 9/1998 | Rezzouk et al. |
| 5,854,662 | A | 12/1998 | Yuyama et al. |
| 5,886,681 | A | 3/1999 | Walsh et al. |
| 5,889,567 | A | 3/1999 | Swanson et al. |
| 5,892,325 | A | 4/1999 | Gleckman |
| 5,901,266 | A | 5/1999 | Whitehead |
| 5,912,651 | A | 6/1999 | Bitzakidis et al. |
| 5,939,830 | A | 8/1999 | Praiswater |
| 5,940,057 | A | 8/1999 | Lien et al. |
| 5,959,777 | A | 9/1999 | Whitehead |
| 5,969,704 | A | 10/1999 | Green et al. |
| 5,978,142 | A | 11/1999 | Blackham et al. |
| 5,986,628 | A | 11/1999 | Tuenge et al. |
| 5,991,456 | A | 11/1999 | Rahman et al. |
| 5,995,070 | A | 11/1999 | Kitada |
| 5,999,307 | A | 12/1999 | Whitehead et al. |
| 6,008,929 | A | 12/1999 | Akimoto et al. |
| 6,014,119 | A * | 1/2000 | Staring et al. ..... 345/82 |
| 6,024,462 | A | 2/2000 | Whitehead |
| 6,025,583 | A | 2/2000 | Whitehead |
| 6,043,591 | A | 3/2000 | Gleckman |
| 6,050,704 | A | 4/2000 | Park |
| 6,064,784 | A | 5/2000 | Whitehead et al. |
| 6,067,645 | A | 5/2000 | Yamamoto et al. |
| 6,079,844 | A | 6/2000 | Whitehead et al. |
| 6,111,559 | A | 8/2000 | Motomura et al. |
| 6,111,622 | A | 8/2000 | Abileah |
| 6,120,588 | A | 9/2000 | Jacobson |
| 6,120,839 | A | 9/2000 | Comiskey et al. |
| 6,129,444 | A | 10/2000 | Tognoni |
| 6,160,595 | A | 12/2000 | Kishimoto |
| 6,172,798 | B1 | 1/2001 | Albert et al. |
| 6,211,851 | B1 | 4/2001 | Lien et al. |
| 6,215,920 | B1 | 4/2001 | Whitehead et al. |
| 6,232,948 | B1 | 5/2001 | Tsuchi |
| 6,243,068 | B1 | 6/2001 | Evanicky et al. |
| 6,267,850 | B1 | 7/2001 | Bailey et al. |
| 6,268,843 | B1 | 7/2001 | Arakawa |
| 6,276,801 | B1 | 8/2001 | Fielding |
| 6,300,931 | B1 | 10/2001 | Someya et al. |
| 6,300,932 | B1 | 10/2001 | Albert |

| | | | |
|---|---|---|---|
| 6,304,365 | B1 | 10/2001 | Whitehead |
| 6,323,455 | B1 | 11/2001 | Bailey et al. |
| 6,323,989 | B1 | 11/2001 | Jacobsen et al. |
| 6,327,072 | B1 | 12/2001 | Comiskey et al. |
| RE37,594 | E | 3/2002 | Whitehead |
| 6,359,662 | B1 | 3/2002 | Walker |
| 6,377,383 | B1 | 4/2002 | Whitehead et al. |
| 6,384,979 | B1 | 5/2002 | Whitehead et al. |
| 6,400,436 | B1 | 6/2002 | Komatsu |
| 6,414,664 | B1 | 7/2002 | Conover et al. |
| 6,418,253 | B2 | 7/2002 | Whitehead |
| 6,424,369 | B1 | 7/2002 | Adair et al. |
| 6,428,189 | B1 | 8/2002 | Hochstein |
| 6,435,654 | B1 | 8/2002 | Wang et al. |
| 6,437,921 | B1 | 8/2002 | Whitehead |
| 6,439,731 | B1 | 8/2002 | Johnson et al. |
| 6,448,944 | B2 | 9/2002 | Ronzani et al. |
| 6,448,951 | B1 | 9/2002 | Sakaguchi et al. |
| 6,448,955 | B1 | 9/2002 | Evanicky et al. |
| 6,452,734 | B1 | 9/2002 | Whitehead et al. |
| 6,483,643 | B1 | 11/2002 | Zuchowski |
| 6,507,327 | B1 | 1/2003 | Atherton et al. |
| 6,545,677 | B2 | 4/2003 | Brown |
| 6,559,827 | B1 | 5/2003 | Mangerson |
| 6,573,928 | B1 | 6/2003 | Jones et al. |
| 6,574,025 | B2 | 6/2003 | Whitehead et al. |
| 6,590,561 | B1 | 7/2003 | Kabel et al. |
| 6,597,339 | B1 | 7/2003 | Ogawa |
| 6,608,614 | B1 | 8/2003 | Johnson |
| 6,624,828 | B1 | 9/2003 | Dresevic et al. |
| 6,657,607 | B1 | 12/2003 | Evanicky et al. |
| 6,680,834 | B2 | 1/2004 | Williams |
| 6,690,383 | B1 | 2/2004 | Braudaway et al. |
| 6,697,110 | B1 | 2/2004 | Jaspers et al. |
| 6,700,559 | B1 | 3/2004 | Tanaka et al. |
| 6,753,876 | B2 | 6/2004 | Brooksby et al. |
| 6,788,280 | B2 | 9/2004 | Ham |
| 6,791,520 | B2 | 9/2004 | Choi |
| 6,803,901 | B1 | 10/2004 | Numao |
| 6,816,141 | B1 | 11/2004 | Fergason |
| 6,816,142 | B2 | 11/2004 | Oda et al. |
| 6,816,262 | B1 | 11/2004 | Slocum et al. |
| 6,828,816 | B2 | 12/2004 | Ham |
| 6,834,125 | B2 | 12/2004 | Woodell et al. |
| 6,846,098 | B2 | 1/2005 | Bourdelais et al. |
| 6,856,449 | B2 | 2/2005 | Winkler et al. |
| 6,862,012 | B1 | 3/2005 | Funakoshi et al. |
| 6,864,916 | B1 | 3/2005 | Nayar et al. |
| 6,885,369 | B2 | 4/2005 | Tanahashi et al. |
| 6,891,672 | B2 | 5/2005 | Whitehead et al. |
| 6,900,796 | B2 | 5/2005 | Yasunishi et al. |
| 6,932,477 | B2 | 8/2005 | Stanton |
| 6,954,193 | B1 | 10/2005 | Andrade et al. |
| 6,975,369 | B1 | 12/2005 | Burkholder |
| 7,002,546 | B1 | 2/2006 | Stuppi et al. |
| 7,113,163 | B2 | 9/2006 | Nitta et al. |
| 7,113,164 | B1 | 9/2006 | Kurihara |
| 7,123,222 | B2 | 10/2006 | Borel et al. |
| 7,161,577 | B2 | 1/2007 | Hirakata et al. |
| 2001/0005192 | A1 | 6/2001 | Walton et al. |
| 2001/0013854 | A1 | 8/2001 | Ogoro |
| 2001/0024199 | A1 | 9/2001 | Hughes et al. |
| 2001/0035853 | A1 | 11/2001 | Hoelen et al. |
| 2001/0038736 | A1 | 11/2001 | Whitehead |
| 2001/0048407 | A1 | 12/2001 | Yasunishi et al. |
| 2001/0052897 | A1 | 12/2001 | Nakano et al. |
| 2002/0003520 | A1 | 1/2002 | Aoki |
| 2002/0003522 | A1 | 1/2002 | Baba et al. |
| 2002/0008694 | A1 | 1/2002 | Miyachi et al. |
| 2002/0033783 | A1 | 3/2002 | Koyama |
| 2002/0036650 | A1 | 3/2002 | Kasahara et al. |
| 2002/0044116 | A1 | 4/2002 | Tagawa et al. |
| 2002/0057238 | A1 | 5/2002 | Nitta et al. |
| 2002/0057253 | A1 | 5/2002 | Lim et al. |
| 2002/0063963 | A1 | 5/2002 | Whitehead et al. |
| 2002/0067325 | A1 | 6/2002 | Choi |
| 2002/0067332 | A1 | 6/2002 | Hirakata et al. |
| 2002/0070914 | A1 | 6/2002 | Bruning et al. |
| 2002/0093521 | A1 | 7/2002 | Daly et al. |
| 2002/0105709 | A1 | 8/2002 | Whitehead et al. |
| 2002/0135553 | A1 | 9/2002 | Nagai et al. |
| 2002/0149574 | A1 | 10/2002 | Johnson et al. |
| 2002/0149575 | A1 | 10/2002 | Moon |
| 2002/0154088 | A1 | 10/2002 | Nishimura |
| 2002/0159002 | A1 | 10/2002 | Chang |
| 2002/0159692 | A1 | 10/2002 | Whitehead |
| 2002/0162256 | A1 | 11/2002 | Wardle et al. |
| 2002/0171617 | A1 | 11/2002 | Fuller |
| 2002/0175907 | A1 | 11/2002 | Sekiya et al. |
| 2002/0180733 | A1 | 12/2002 | Colmenarez et al. |
| 2002/0190940 | A1 | 12/2002 | Itoh et al. |
| 2003/0012448 | A1 | 1/2003 | Kimmel et al. |
| 2003/0026494 | A1 | 2/2003 | Woodell et al. |
| 2003/0043394 | A1 | 3/2003 | Kuwata et al. |
| 2003/0048393 | A1 | 3/2003 | Sayag |
| 2003/0053689 | A1 | 3/2003 | Watanabe et al. |
| 2003/0072496 | A1 | 4/2003 | Woodell et al. |
| 2003/0090455 | A1 | 5/2003 | Daly |
| 2003/0107538 | A1 | 6/2003 | Asao et al. |
| 2003/0108245 | A1 | 6/2003 | Gallagher et al. |
| 2003/0112391 | A1 | 6/2003 | Jang et al. |
| 2003/0128337 | A1 | 7/2003 | Jaynes et al. |
| 2003/0132905 | A1 | 7/2003 | Lee et al. |
| 2003/0142118 | A1 | 7/2003 | Funamoto et al. |
| 2003/0169247 | A1 | 9/2003 | Kawabe et al. |
| 2003/0179221 | A1 | 9/2003 | Nitta et al. |
| 2003/0197709 | A1 | 10/2003 | Shimazaki et al. |
| 2004/0012551 | A1 | 1/2004 | Ishii |
| 2004/0041782 | A1 | 3/2004 | Tachibana |
| 2004/0051724 | A1 | 3/2004 | Elliott et al. |
| 2004/0057017 | A1 | 3/2004 | Childers et al. |
| 2004/0100437 | A1 * | 5/2004 | Hunter et al. ..... 345/102 |
| 2004/0239587 | A1 | 12/2004 | Murata et al. |
| 2004/0263450 | A1 | 12/2004 | Lee et al. |
| 2005/0073495 | A1 | 4/2005 | Harbers et al. |
| 2005/0088403 | A1 | 4/2005 | Yamazaki |
| 2005/0157298 | A1 | 7/2005 | Evanicky et al. |
| 2005/0190164 | A1 | 9/2005 | Velthoven et al. |
| 2005/0200295 | A1 | 9/2005 | Lim et al. |
| 2005/0225561 | A1 | 10/2005 | Higgins et al. |
| 2005/0225574 | A1 | 10/2005 | Brown et al. |
| 2005/0259064 | A1 | 11/2005 | Sugino et al. |
| 2006/0071936 | A1 | 4/2006 | Leyvi et al. |
| 2006/0104508 | A1 | 5/2006 | Daly et al. |
| 2006/0120598 | A1 | 6/2006 | Takahashi et al. |
| 2006/0208998 | A1 | 9/2006 | Okishiro et al. |
| 2007/0052636 | A1 | 3/2007 | Kalt et al. |
| 2008/0025634 | A1 | 1/2008 | Border et al. |
| 2008/0088560 | A1 | 4/2008 | Bae et al. |

FOREIGN PATENT DOCUMENTS

| | | |
|---|---|---|
| EP | 0 829 747 A1 | 3/1998 |
| EP | 0 606 162 B1 | 11/1998 |
| EP | 0912047 | 4/1999 |
| EP | 0 963 112 A1 | 12/1999 |
| EP | 1168243 | 1/2002 |
| EP | 1 202 244 A1 | 5/2002 |
| EP | 1 206 130 A1 | 5/2002 |
| EP | 1 313 066 A1 | 5/2003 |
| EP | 1 316 919 A2 | 6/2003 |
| EP | 1 453 002 | 9/2004 |
| EP | 1 453 030 A1 | 9/2004 |
| FR | 2 611 389 | 2/1987 |
| GB | 2 388 737 | 11/2003 |
| JP | 64-10299 | 1/1989 |

| | | |
|---|---|---|
| JP | 1-98383 | 4/1989 |
| JP | 3-71111 | 3/1991 |
| JP | 3-198026 | 8/1991 |
| JP | 5-66501 | 3/1993 |
| JP | 5-80716 | 4/1993 |
| JP | 5-273523 | 10/1993 |
| JP | 5-289044 | 11/1993 |
| JP | 6-247623 | 9/1994 |
| JP | 6-313018 | 11/1994 |
| JP | 7-121120 | 5/1995 |
| JP | 9-244548 | 9/1997 |
| JP | 10-508120 | 8/1998 |
| JP | 11-052412 | 2/1999 |
| JP | 2000-206488 | 7/2000 |
| JP | 2000-275995 | 10/2000 |
| JP | 2000-321571 | 11/2000 |
| JP | 2001-142409 | 5/2001 |
| JP | 2002-091385 | 3/2002 |
| JP | 2002-099250 | 4/2002 |
| JP | 2003-204450 | 7/2003 |
| JP | 2003-230010 | 8/2003 |
| JP | 3523170 | 2/2004 |
| JP | 2004-294540 | 10/2004 |
| KR | 10-2004-0084777 | 10/2004 |
| TW | 406206 | 9/2000 |
| WO | WO 91/15843 | 10/1991 |
| WO | WO 93/20660 | 10/1993 |
| WO | WO 96/33483 | 10/1996 |
| WO | WO 98/08134 | 2/1998 |
| WO | WO 00/75720 | 12/2000 |
| WO | WO 01/69584 | 9/2001 |
| WO | WO 02/03687 | 1/2002 |
| WO | WO 02/079862 | 10/2002 |
| WO | WO 03/077013 | 9/2003 |
| WO | WO 2004/013835 | 2/2004 |

OTHER PUBLICATIONS

Fumiaki Yamada and Yoichi Taira, "An LED backlight for color LCD," IBM Research, Tokyo Research Laboratory, 1623-14, Shimotsuruma, Yamato, Kanagawa-ken 242-8502, Japan, IDW'00, pp. 363-366.

A.A.S. Sluyterman and E.P. Boonekamp, "18.2: Architectural Choices in a Scanning Backlight for Large LCD TVs," Philips Lighting, Bld. HBX-p, PO Box 80020, 5600 JM Eindhoven, The Netherlands, SID 05 Digest, pp. 996-999.

Fumiaki Yamada, Hajime Nakamura, Yoshitami Sakaguchi, and Yoichi Taira, "52.2: Invited Paper: Color Sequential LCD Based on OCB with an LED Backlight," Tokyo Research Laboratory, IBM Research, Yamato, Kanagawa, Japan, SID 00 Digest, pp. 1180-1183.

Ngai-Man Cheung, et al., "Configurable entropy coding scheme for H.26L," ITU—Telecommunications Standardization Sector, Study Group 16 Question 6 Video Coding Experts Group (VCGE), Twelfth Meeting: Eibsee, Germany, Jan. 9-12, 2001, pp. 1-11.

T. Funamoto, T. Kobayashi, T. Murao, "High-Picture-Quality Technique for LCD televisions: LCD-AI," AVC Products Development Center, Matsushita Electric Industrial, Co., Ltd., 1-1 Matsushita-cho, Ibaraki, Osaka 567-0026 Japan, 2 pages, date unknown.

Steven L. Wright, et al., "Measurement and Digital compensation of Crosstalk and Photoleakage in High-Resolution TFTLCDs," IBM T.J. Watson Research Center, PO Box 218 MS 10-212, Yorktown Heights, NY 10598, pp. 1-12, date unknown.

Paul E. Debevec and Jitendra Malik, "Recovering High Dynamic Range Radiance Maps from Photographs," Proceedings of SIGGRAPH 97, Computer Graphics Proceedings, Annual Conference Series, pp. 369-378 (Aug. 1997, Los Angeles, California). Addison Wesley, Edited by Turner Whitted. ISBN 0-89791-896-7.

DiCarlo, J.M. and Wandell, B. (2000), "Rendering high dynamic range images," in Proc. IS&T/SPIE Electronic Imaging 2000. Image Sensors, vol. 3965, San Jose, CA, pp. 392-401.

Kuang, J., Yamaguchi, H., Johnson, G.M. and Fairchild, M.D. (2004), "Testing HDR image rendering algorithms (Abstract)," in Proc. IS&T/SID Twelfth Color Imaging Conference: Color Science, Systems, and Application, Scottsdale, AR, pp. 315-320.

Durand, F. and Dorsey, J. (2002), "Fast bilateral filtering for the display of high dynamic-range images," in Proc. ACM SIGGRAPH 2002, Annual Conference on Computer Graphics, San Antonia, CA, pp. 257-266.

Kang, S.B., Uyttendaele, M., Winder, S. and Szeliski, R. (2003), "High Dynamic Range Video," ACM Transactions on Graphics 22(3), 319-325.

Brian A. Wandell and Louis D. Silverstein, "The Science of Color," 2003, Elsevier Ltd, Ch. 8 Digital Color Reproduction, pp. 281-316.

* cited by examiner

LCD system configuration

Flow chart of deriving LED and LCD driving values for HDR display

TECHNIQUE THAT PRESERVES SPECULAR HIGHLIGHTS

CROSS-REFERENCE TO RELATED APPLICATIONS

This application claims the benefit of U.S. Provisional Application No. 60/628,799, filed Nov. 16, 2004, entitled "Algorithm to Preserve Specular Highlight for High Dynamic Range Displays."

BACKGROUND OF THE INVENTION

The present invention relates to backlit displays and, more particularly, to a backlit display with improved performance characteristics.

The local transmittance of a liquid crystal display (LCD) panel or a liquid crystal on silicon (LCOS) display can be varied to modulate the intensity of light passing from a backlit source through an area of the panel to produce a pixel that can be displayed at a variable intensity. Whether light from the source passes through the panel to an viewer or is blocked is determined by the orientations of molecules of liquid crystals in a light valve.

Since liquid crystals do not emit light, a visible display requires an external light source. Small and inexpensive LCD panels often rely on light that is reflected back toward the viewer after passing through the panel. Since the panel is not completely transparent, a substantial part of the light is absorbed during its transits of the panel and images displayed on this type of panel may be difficult to see except under the best lighting conditions. On the other hand, LCD panels used for computer displays and video screens are typically backlit with fluorescent tubes or arrays of light-emitting diodes (LEDs) that are built into the sides or back of the panel. To provide a display with a more uniform light level, light from these points or line sources is typically dispersed in a diffuser panel before impinging on the light valve that controls transmission to a viewer.

The transmittance of the light valve is controlled by a layer of liquid crystals interposed between a pair of polarizers. Light from the source impinging on the first polarizer comprises electromagnetic waves vibrating in a plurality of planes. Only that portion of the light vibrating in the plane of the optical axis of a polarizer can pass through the polarizer. In an LCD the optical axes of the first and second polarizers are arranged at an angle so that light passing through the first polarizer would normally be blocked from passing through the second polarizer in the series. However, a layer of translucent liquid crystals occupies a cell gap separating the two polarizers. The physical orientation of the molecules of liquid crystal can be controlled and the plane of vibration of light transiting the columns of molecules spanning the layer can be rotated to either align or not align with the optical axes of the polarizers. It is to be understood that normally white may likewise be used.

The surfaces of the first and second polarizers forming the walls of the cell gap are grooved so that the molecules of liquid crystal immediately adjacent to the cell gap walls will align with the grooves and, thereby, be aligned with the optical axis of the respective polarizer. Molecular forces cause adjacent liquid crystal molecules to attempt to align with their neighbors with the result that the orientation of the molecules in the column spanning the cell gap twist over the length of the column. Likewise, the plane of vibration of light transiting the column of molecules will be "twisted" from the optical axis of the first polarizer to that of the second polarizer. With the liquid crystals in this orientation, light from the source can pass through the series polarizers of the translucent panel assembly to produce a lighted area of the display surface when viewed from the front of the panel. It is to be understood that the grooves may be omitted in some configurations.

To darken a pixel and create an image, a voltage, typically controlled by a thin film transistor, is applied to an electrode in an array of electrodes deposited on one wall of the cell gap. The liquid crystal molecules adjacent to the electrode are attracted by the field created by the voltage and rotate to align with the field. As the molecules of liquid crystal are rotated by the electric field, the column of crystals is "untwisted,'and the optical axes of the crystals adjacent the cell wall are rotated out of alignment with the optical axis of the corresponding polarizer progressively reducing the local transmittance of the light valve and the intensity of the corresponding display pixel. Color LCD displays are created by varying the intensity of transmitted light for each of a plurality of primary color elements (typically, red, green, and blue) that make up a display pixel.

LCDs can produce bright, high resolution, color images and are thinner, lighter, and draw less power than cathode ray tubes (CRTs). As a result, LCD usage is pervasive for the displays of portable computers, digital clocks and watches, appliances, audio and video equipment, and other electronic devices. On the other hand, the use of LCDs in certain "high end markets, such as video and graphic arts, is frustrated, in part, by the limited performance of the display.

The liquid crystal display tends to have a limited dynamic range due to the extinction ratio of polarizers and imperfections due to the nature of liquid crystal material. In order to effectively display increasingly high dynamic images, a low resolution light emitting diode backlight may used to modulate the light that is provided to a higher resolution liquid crystal material. By the combination of the LED together with the LCD, a high dynamic range display can be achieved. Due to the lower resolution LED compared to the higher resolution of the LCD, the display has limits on its ability to display a high dynamic pattern of high spatial resolution. The display in many cases can simultaneously present an image that is both very bright (>2000 cd/m$^2$) and very dark (<0.5 cd/m$^2$). The human eye has limited dynamic range in a local area, and with visual masking, the eye can hardly perceive the limited dynamic range of high spatial frequency content.

FIG. 1 shows a technique to convert a high spatial resolution ("HDR") image into a lower resolution LED image and a high resolution LCD image. The luminance of the HDR image is first low pass filtered and subsampled to the resolution of the LED array. A cross-talk correction may be applied. This low pass filtered and subsampled image determines the LED image that will drive the LED array using a raster decoder and a control line. The backlight image is predicted by convolving an upsampled LED image with the point spread function of the LED. An LCD image is then derived by dividing the original HDR image with the predicted backlight image. The final displayed image is thus the product of LED backlight image and the LCD transmittance to reproduce the image. Unfortunately, the resulting image tends to be lacking some of the fine spatial highlights.

What is desired, therefore, is a liquid crystal display having improved spatial highlights.

BRIEF DESCRIPTION OF THE DRAWINGS

FIG. 4 illustrates a flashing backlight scheme.

DETAILED DESCRIPTION OF THE PREFERRED EMBODIMENT

Figure 1:
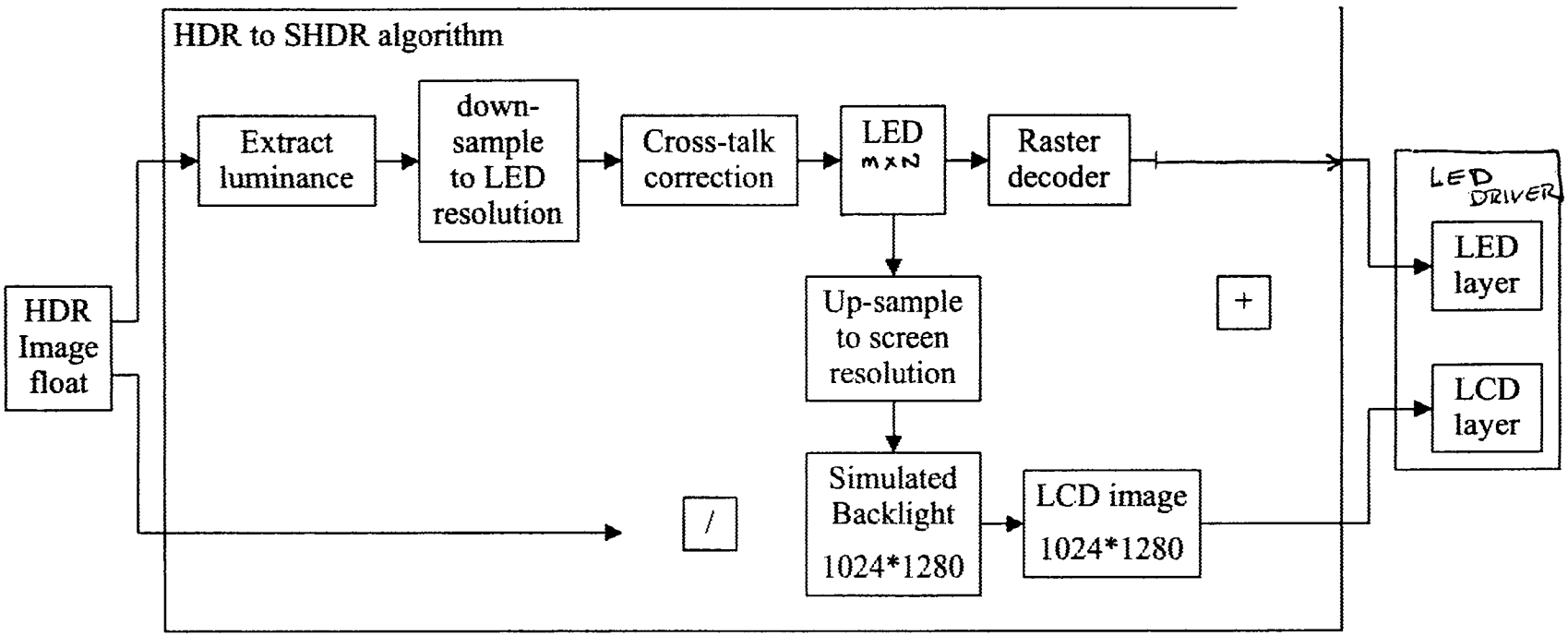
FIG. 1 is a liquid crystal display driving technique.
Figure 2A:
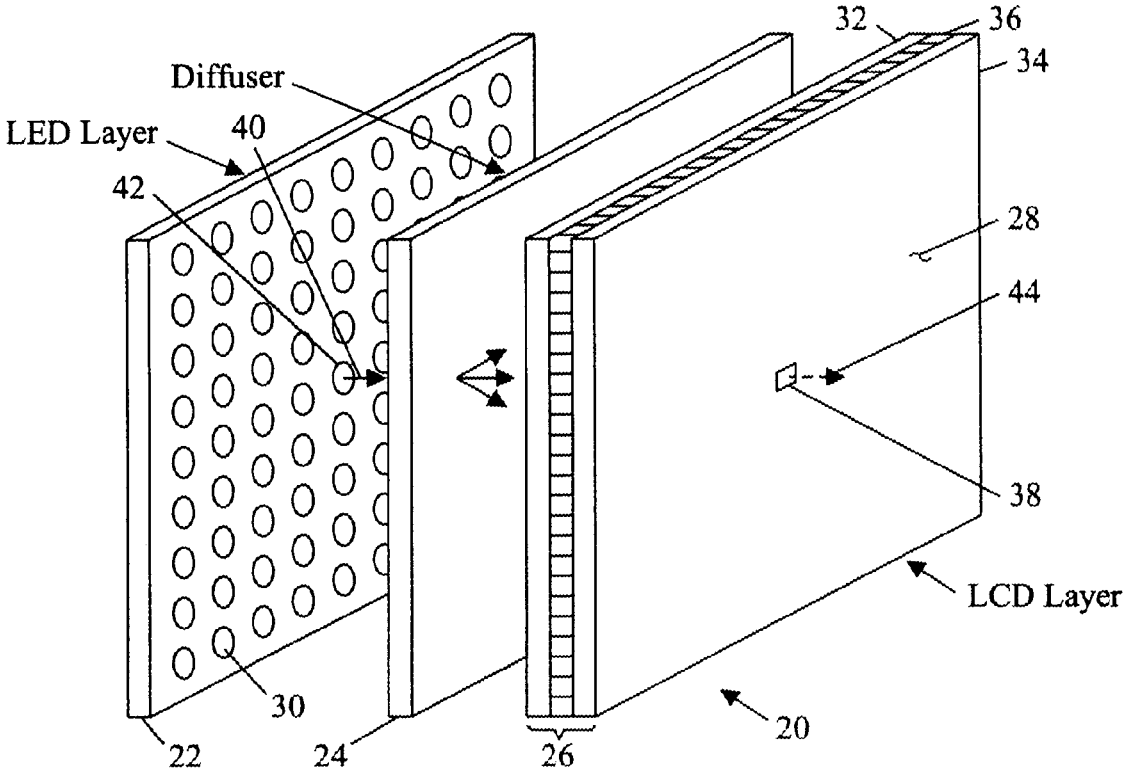
FIGS. 2A and 2B are schematic diagrams of liquid crystal displays (LCDs).
Figure 2B:
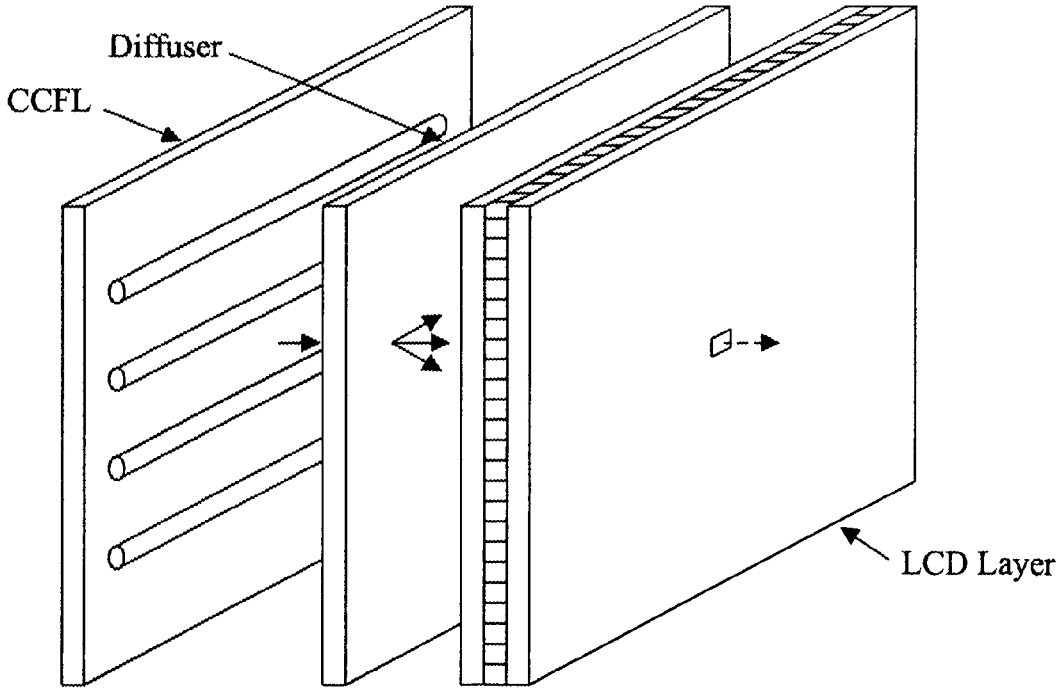

Referring to FIG. 2A, a backlit display 20 comprises, generally, a backlight 22, a diffuser 24, and a light valve 26 (indicated by a bracket) that controls the transmittance of light from the backlight 22 to a user viewing an image displayed at the front of the panel 28. The light valve, typically comprising a liquid crystal apparatus, is arranged to electronically control the transmittance of light for a picture element or pixel. Since liquid crystals do not emit light, an external source of light is necessary to create a visible image. The source of light for small and inexpensive LCDs, such as those used in digital clocks or calculators, may be light that is reflected from the back surface of the panel after passing through the panel. Likewise, liquid crystal on silicon (LCOS) devices rely on light reflected from a backplane of the light valve to illuminate a display pixel. However, LCDs absorb a significant portion of the light passing through the assembly and an artificial source of light such as the backlight 22 comprising fluorescent light tubes or an array of light sources 30 (e.g., light-emitting diodes (LEDs)), as illustrated in FIGS. 2A and 2B, are useful to produce pixels of sufficient intensity for highly visible images or to illuminate the display in poor lighting conditions. There may not be a light source 30 for each pixel of the display and, therefore, the light from the point or line sources is typically dispersed by a diffuser panel 24 so that the lighting of the front surface of the panel 28 is more uniform.

Light radiating from the light sources 30 of the backlight 22 comprises electromagnetic waves vibrating in random planes. Only those light waves vibrating in the plane of a polarizer's optical axis can pass through the polarizer. The light valve 26 includes a first polarizer 32 and a second polarizer 34 having optical axes arrayed at an angle so that normally light cannot pass through the series of polarizers. Images are displayable with an LCD because local regions of a liquid crystal layer 36 interposed between the first 32 and second 34 polarizer can be electrically controlled to alter the alignment of the plane of vibration of light relative of the optical axis of a polarizer and, thereby, modulate the transmittance of local regions of the panel corresponding to individual pixels 36 in an array of display pixels.

The layer of liquid crystal molecules 36 occupies a cell gap having walls formed by surfaces of the first 32 and second 34 polarizers. The walls of the cell gap are rubbed to create microscopic grooves aligned with the optical axis of the corresponding polarizer. The grooves cause the layer of liquid crystal molecules adjacent to the walls of the cell gap to align with the optical axis of the associated polarizer. As a result of molecular forces, each succeeding molecule in the column of molecules spanning the cell gap will attempt to align with its neighbors. The result is a layer of liquid crystals comprising innumerable twisted columns of liquid crystal molecules that bridge the cell gap. As light 40 originating at a light source element 42 and passing through the first polarizer 32 passes through each translucent molecule of a column of liquid crystals, its plane of vibration is "twisted" so that when the light reaches the far side of the cell gap its plane of vibration will be aligned with the optical axis of the second polarizer 34. The light 44 vibrating in the plane of the optical axis of the second polarizer 34 can pass through the second polarizer to produce a lighted pixel 28 at the front surface of the display 28.

To darken the pixel 28, a voltage is applied to a spatially corresponding electrode of a rectangular array of transparent electrodes deposited on a wall of the cell gap. The resulting electric field causes molecules of the liquid crystal adjacent to the electrode to rotate toward alignment with the field. The effect is to "untwist" the column of molecules so that the plane of vibration of the light is progressively rotated away from the optical axis of the polarizer as the field strength increases and the local transmittance of the light valve 26 is reduced. As the transmittance of the light valve 26 is reduced, the pixel 28 progressively darkens until the maximum extinction of light 40 from the light source 42 is obtained. Color LCD displays are created by varying the intensity of transmitted light for each of a plurality of primary color elements (typically, red, green, and blue) elements making up a display pixel. Other arrangements of structures may likewise be used.

After observing limitations in existing devices, it was determined that many high dynamic range ("HDR") images contain specular highlights that are extremely bright but are very small in spatial extent. It was further determined that one principal cause of images lacking fine spatial highlights is the aggressive low pass filtering process that smears this specular highlight causing the corresponding LED to have a lower value. Although any spatial details lost in the filtering step may be theoretically recovered in the LCD image via the division operation, the actual LCD cannot recover bright specular highlights due to its limited range (its transmittance can not exceed 1). Thus, a portion of the specular highlights are not present in the final display image although the HDR is otherwise capable of displaying that bright highlight.

Figure 3:
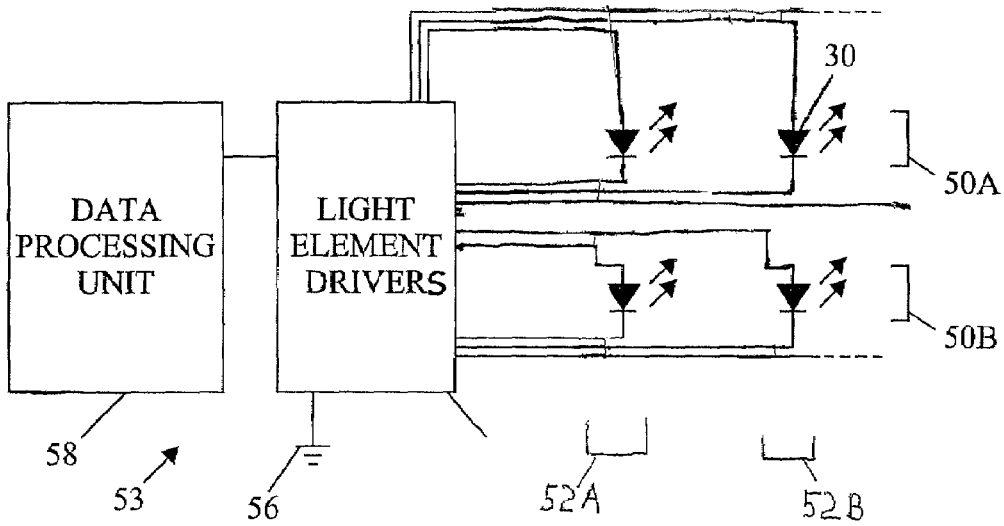
FIG. 3 is a schematic diagram of a driver for modulating the illumination of a plurality of light source elements of a backlight.

In the backlit display 20 the backlight 22 comprises an array of locally controllable light sources 30. The individual light sources 30 of the backlight may be light-emitting diodes (LEDs), an arrangement of phosphors and lensets, or other suitable light-emitting devices. In addition, the backlight may include a set of independently controllable light sources, such as one or more cold cathode ray tubes. The light-emitting diodes may be 'white' and/or separate colored light emitting diodes. The individual light sources 30 of the backlight array 22 are independently controllable to output light at a luminance level independent of the luminance level of light output by the other light sources so that a light source can be modulated in response to any suitable signal. Similarly, a film or material may be overlaid on the backlight to achieve the spatial and/or temporal light modulation. Referring to FIG. 3, the light sources 30 (LEDs illustrated) of the array 22 are typically arranged in the rows, for examples, rows 50*a* and 50*b*, (indicated by brackets) and columns, for examples, columns 52*a* and 52*b* (indicated by brackets) of a rectangular array. The output of the light sources 30 of the backlight are controlled by a backlight driver 53, with a current driver for each light source. The light sources 30 are driven by light source drivers 54 that powers the elements by selecting and connecting a selected light source 30 of the selected column to ground 56. A data processing unit 58, processing the digital values for pixels of an image to be displayed, provides a signal to the light drivers 54 to select the appropriate light source 30 corresponding to the displayed pixel and to drive the light source with a power level to produce an appropriate level of illumination of the light source.

Figure 4:
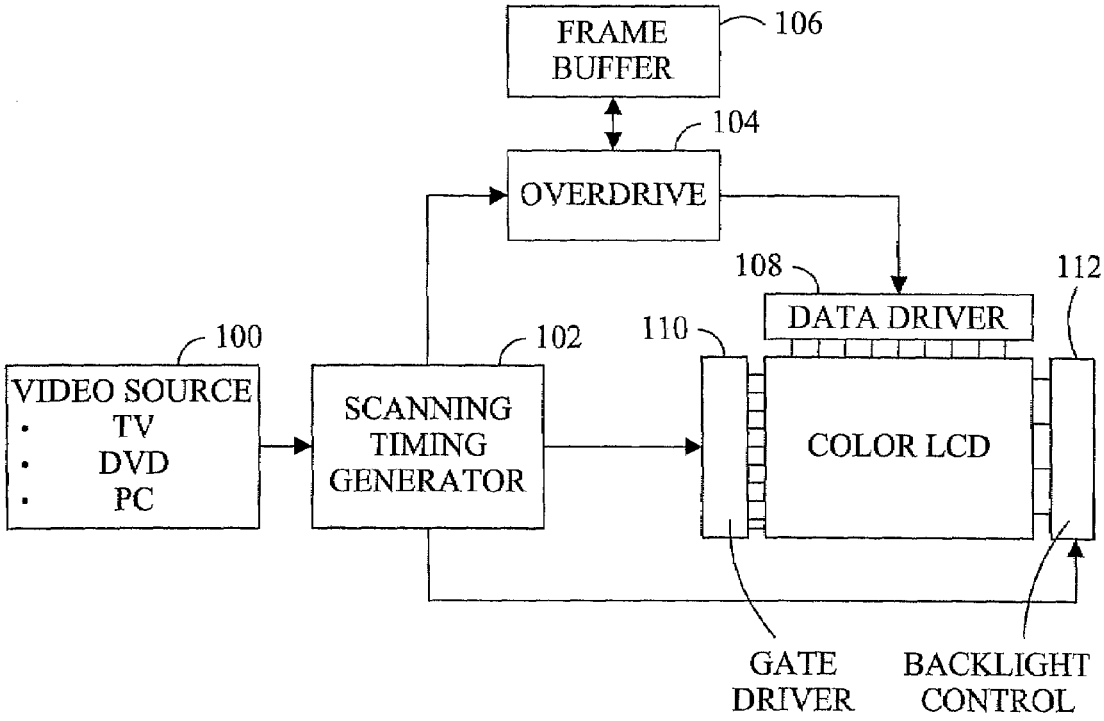
FIG. 4 illustrates a LCD system configuration.

FIG. 4 illustrates a block diagram of a typical data path within a liquid crystal panel. The video data 100 may be provided from any suitable source, such as for example, television broadcast, Internet connection, file server, digital video disc, computer, video on demand, or broadcast. The video data 100 is provided to a scanning and timing generator 102 where the video data is converted to a suitable format for presentation on the display. In many cases, each line of data is provided to an overdrive circuit 104, in combination with a frame buffer 106, to compensate for the slow temporal response of the display. The signal from the overdrive 104 is preferably converted to a voltage value in the data driver 108 which is output to individual data electrodes of the display. The generator 102 also provides a clock signal to the gate driver 110, thereby selecting one row at a time, which stores the voltage data on the data electrode on the storage capacitor of each pixel of the display. The generator 102 also provides backlight control signals 112 to control the level of luminance from the backlight, and/or the color or color balance of the light provided in the case of spatially non-uniform backlight (e.g., based upon image content and/or spatially different in different regions of the display).

FIGS. 2A, 3 and 4 show a schematic of a HDR display with the LED layer as a backlight for the LCD. The light from an array of LEDs passes through the diffusion layer and illuminates the LCD. The backlight image may be characterized as:

$$bl(x, y)=\mathrm{LED}(i, j)*psf(x, y)$$

where LED(ij) is the LED output level of each LED, and psf(x,y) is the point spread function of the diffusion layer, and * denotes a convolution operation. The backlight image is further modulated by the LCD.

The displayed image is the product of LED backlight and transmittance of LCD: $T_{LCD}(x,y)$.

$$img(x, y)=bl(x, y)T_{LCD}(x, y)=(\mathrm{LED}(i, j)*psf(x, y))T_{LCD}(x, y)$$

By combining the LED and LCD, the dynamic range of the display may be represented as the product of the dynamic range of LED and LCD.

Since the LED has a low spatial resolution, it may represent a local constant valve (or DC term); while the LCD may represent the spatial detail (AC term). It is preferred that the LCD is used with a generally maximum effective working modulation range: both up (brighter) and down (darker). So the preferred LCD value should be around the half point of the dynamic range (e.g., 0.5 (or 0.4 to 0.6) for the range from 0 to 1, or between 0.25 and 0.75 for the range from 0 to 1). This selection of the LCD value leaves the LED value to be twice (or otherwise) of the HDR image.

Figure 5:
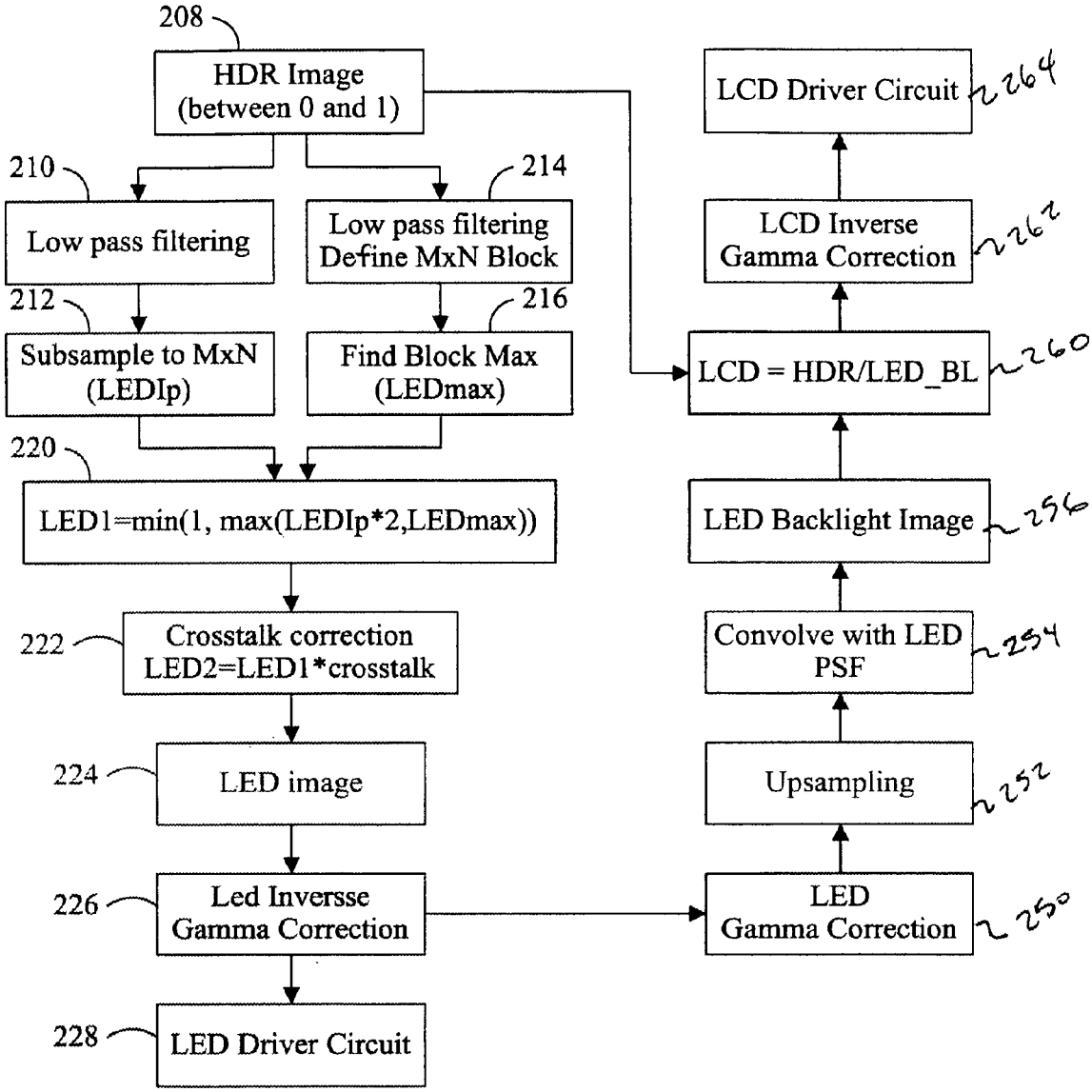
FIG. 5 illustrates an HDR image processing technique.

FIG. 5 shows an exemplary technique to convert an image into a low resolution LED image and a high resolution LCD image. The LCD resolution is m×n pixels with its range from 0 to 1, with 0 being black and 1 being the maximum transmittance. The LED resolution is M×N with M<m and N<n. For simplicity, it is assumed that the HDR image has the same resolution as LCD merely for purposes of illustration. If HDR image has a different resolution than the LCD image (greater or lesser), a scaling or cropping operation may be used to convert the HDR image to LCD image resolution.

A desirable LED backlight is derived from the HDR image. The HDR image is low pass filtered 210 by the point spread function of the diffusion screen (which is between the LED and the LCD in many configurations) and sub-sampled (down sampled) to the LED resolution of M×N. The same HDR image 208 is also lowpass filtered 214 by a small filter kernel, such as 5×5, to simulate the size of the anticipated specular pattern. The result is then separated into M×N blocks 216, each block corresponding to one LED with some overlap of the pixels between each block. The block size may be (1+k)*(m/M×n/N), where k is the overlapping factor. k=0.5 is used in the preferred embodiment. Accordingly, the blocks may form a series of overlapping regions, where a portion of a pair of adjacent regions are shared. For each block, the block maximum or substantial maximum may be used to form a LEDmax image (M×N).

The local region maximum may likewise be another value that is substantially a maximum value of the local region. One way to characterize the selection of a substantial maximum is using an image that has a substantially uniform (or uniform) distribution of intensity values across the image where the variability in the luminance has one standard deviation. The selected substantial maximum for each region (such as 5×5 or 10×10) is preferably selected as being within 0.5 or 0.25 of a standard deviation. This substantial maximum is preferably selected for a majority, more preferably 75% or more, and more preferably all of the regions of the display.

From these two LED images, the system selects the larger of 2*LED1p and LEDmax, i.e.

$$\mathrm{LED1}=\min(\max(\mathrm{LED1}p*2,\mathrm{LEDmax}), 1)$$

The min operation 220 is used to constrain the LED value from 0 to 1. This approach takes into account the local maximum thus preserving the specular highlight (LEDmax). This approach also takes into account the non-specular highlight area where the system sets the LED1 to be twice that of the LED1p to ensure substantially maximum LCD operating range. This accommodates areas with both high dynamic range and high spatial frequency. The use of a system with two separate tests, of the type described or otherwise, permits different display characteristics to be accommodated. Alternatively, a system with the substantial maximum test may be used.

Figure 6:
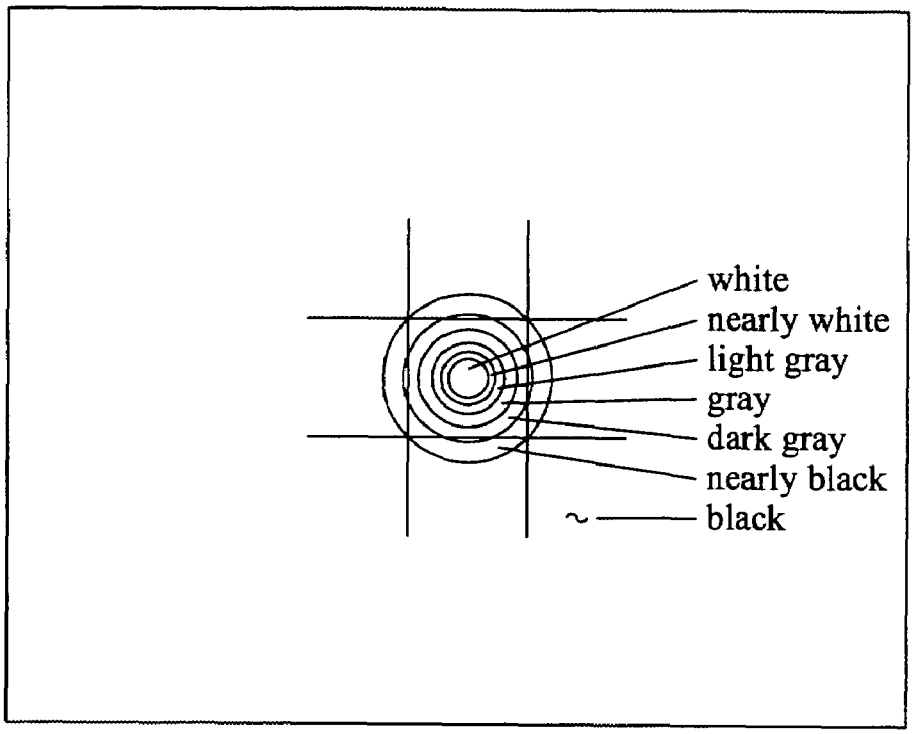
FIG. 6 illustrates a PSF.

The LED1 is of size M×N and range from 0 to 1. Since the PSF of diffusion screen is larger than the LED spacing to provide a more uniform backlight image, there may be considerable crosstalk between the LED elements that are located close together. Also, the block size M×N is greater than the LED spacing. FIG. 6 shows a typical LED PSF with the black lines that indicate the borders between LEDs. It may be observed that the PSF extends beyond its border.

Figure 7:
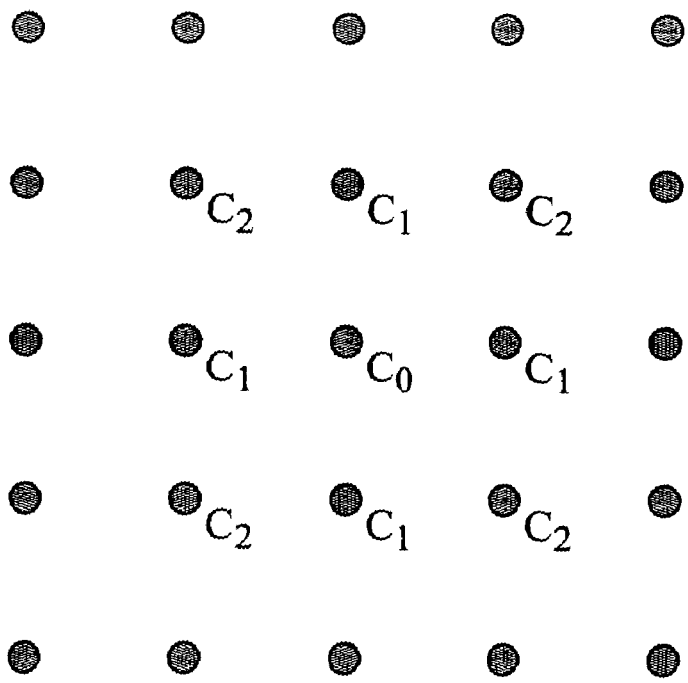
FIG. 7 illustrates cross talk correction.

Because of the PSF of the diffusion screen, each LED has contribution from its neighboring LEDs. If this crosstalk is not modified, the LED backlight image could be sufficiently high that it will limit the LCD dynamic range. The modified LED value can be derived from a matrix inversion of an MN×MN array of crosstalk coefficients, where MN is the total number of LEDs in the backlights. Each coefficient ($c_{ij}$) represents the crosstalk of $i^{th}$ LED to $j^{th}$ LED. The computation of MN×MN matrix inversion tends to be computationally intensive for large MN, thus the correction may be approximated with a convolution operation. To reduce the computation, the system may consider the LEDs that are close by as shown in FIG. 7 since the LEDs that are farther away having smaller effect. The convolution kernel may be given by:

$$\text{crosstalk}=\begin{vmatrix} c_2 & c_1 & c_2 \\ c_1 & c_0 & c_1 \\ c_2 & c_1 & c_2 \end{vmatrix}$$

where $c_0$, $c_1$ and $c_2$ are coefficients of correction. These coefficients are chosen to best approximate the matrix inversion data. In the preferred embodiment, c0=3.4, c1=−0.4, and c2=−0.2. These values will change with the arrangement of the LEDs as well as the PSF of LED.

Figure 8:
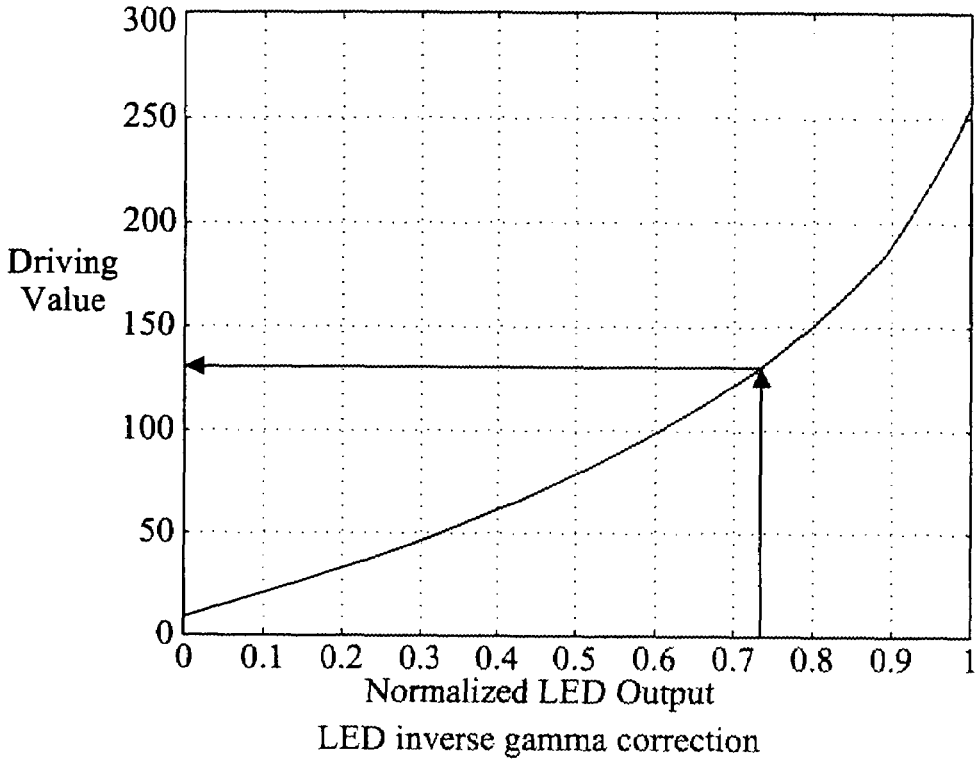
FIG. 8 illustrates normalized LED output.

The LED value at 222 (see FIG. 5) is given by:

$$LED2=LED1*crosstalk$$

where * denotes the convolution operation. Since the LED output is non-linear with respect to the driving value and it driving value is integer, inverse gamma correction and quantization may be performed to determine the LED driving value. FIG. 8 shows the process of inverse gamma correction for LED. The quantized driving value 224 is again gamma corrected 226 and this is the actual LED driver circuit values 228.

Referring to FIG. 5, the next step is to predict the backlight image 256 from the LED. The LED image is gamma corrected 250, upsampled 252 to the LCD resolution (m×n), and convolved 254 with the PSF of the diffusion screen. The LCD transmittance 260 is $$T_{LCD}(x, y)=img(x, y)/bl(x, y)$$

Figure 9:
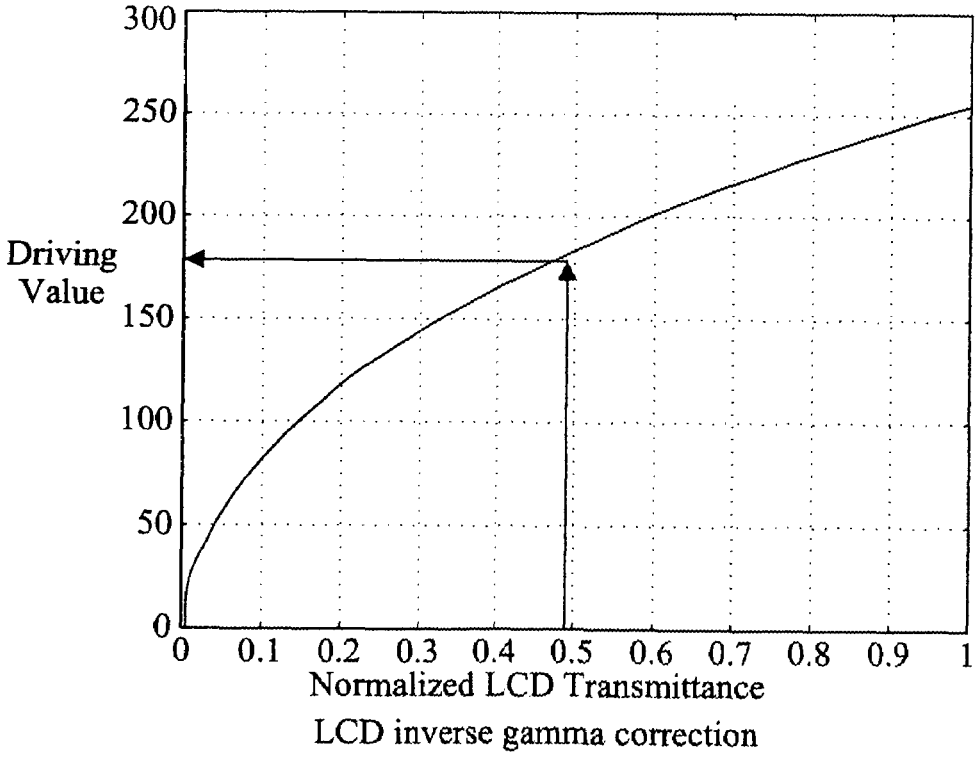
FIG. 9 illustrates normalized LCD transmittance.

Inverse gamma correction 262 is performed, as in FIG. 9, to adjust for the nonlinear response of the LCD to provide data to the LCD driver circuit 264.

In some cases, the luminance may be computed based upon a traditional computation of L=0.3*Red+0.6*Green+0.1*Blue. This luminance computation is then used to compute the suitable signal fro the light emitting diode. While suitable for many situations, it turns out that if the high dynamic range image is primarily blue for a particular region, the luminance for the diode of that region is very small due to the lower weighting provided in the luminance calculation. In particular, in order to produce a pure maximum blue output, the white light emitting diode should operate at its maximum. With a diode having a broad spectrum, such as a white light emitting diode, the luminance computation should enhance the ability to represent a blue spectrum. One suitable technique would use L=max (R,G,B). Another suitable technique includes a transformation where Blue is greater than 15% of the luminance, and more preferable greater than 25% of the luminance. Yet another technique involves selectively increasing the luminance contribution for the blue channel based upon the image content.

All the references cited herein are incorporated by reference.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A method for displaying an image on a liquid crystal display that includes an array of a plurality of light-emitting elements and a light valve, said method comprising:

(a) receiving an said image;

(b) creating a first modification of said received image by:

(i) applying a first low-pass filter to said image to produce a first filtered image; and (ii) sub-sampling said first filtered image at the resolution of said array of plurality of light-emitting elements;

c) creating a second modification of said image, independent from said first modification of said image, by:

(i) applying a second low-pass filter to said image, different from said first low pass filter, to produce a second low pass filtered image, said second low pass filter based on an anticipated specular pattern; and (ii) segmenting said second low pass filtered image into a plurality of blocks, each said block associated with one of said light-emitting elements, and calculating a respective substantial maximum luminance in each said block;

(d) creating a composite of said first modification and said second modification by selecting, for each said light-emitting element, a respective one of either said substantial maximum luminance associated with said light emitting element in said second modification of said image, or a predetermined statistical measure of the sub-sampled luminance value, associated with said light-emitting element, in said first modification of said image; and (e) using said composite to drive said array of a plurality of light-emitting elements.

2. The method of claim 1 where said first low pass filter is based on a point spread function of a diffusion screen over said array of light emitting elements.

3. The method of claim 1 where said statistical measure is twice the sub-sampled luminance value.

4. The method of claim 1 where said plurality of blocks overlap.

5. The method of claim 4 where the overlapping factor is 0.5.

6. The method of claim 1 including the step of applying a correction for crosstalk on said composite.

7. The method of claim 1 where said second low pass filter has a size that simulates that of the anticipated said specular pattern.

8. The method of claim 1 where said substantial maximum luminance associated with said light emitting element is the maximum luminance associated with said light emitting element.

* * * * *